United States Patent [19]

Babcock

[11] 4,389,896

[45] Jun. 28, 1983

[54] BOREHOLE GAUGE FOR IN-SITU MEASUREMENT OF STRESS AND OTHER PHYSICAL PROPERTIES

[75] Inventor: Clarence O. Babcock, Lakewood, Colo.

[73] Assignee: The United States of America as represented by the Secretary of the Interior, Washington, D.C.

[21] Appl. No.: 267,506

[22] Filed: May 27, 1981

[51] Int. Cl.[3] ..... E21B 49/00

[52] U.S. Cl. ..... 73/784

[58] Field of Search ..... 73/784, 783, 767, 768, 73/775; 364/508

[56] References Cited

U.S. PATENT DOCUMENTS 3,885,423 5/1975 Schuermann et al. ..... 73/784

4,155,264 5/1979 Bender et al. ..... 73/783

OTHER PUBLICATIONS

Blackwood, R. L. et al., A Method of Measuring . . . Rock Mass, Aug. 1973, from Conference on Stress . . . Engineering, Brisbane, Australia, pp. 164–169.

*Primary Examiner*—Jerry W. Myracle

*Attorney, Agent, or Firm*—Donald A. Gardiner; Ronald C. Williams

[57] ABSTRACT

This invention relates to a method of gathering information from sensors from which the Young's modulus, Poisson's ratio, and the two principal stresses can be obtained. The absolute secondary principal stresses can also be obtained. The method involves the placement of two inclusions of different, but known, physical properties in a single bore hole with a strain or displacement rosette sensor placed in each inclusion and oriented so as to measure physical properties on a plane normal to the bore hole axis. It is extremely important that intimate contact exists between the inclusions and the bore hole surface, because the physical properties of the two inclusions are different and the interactions between each inclusion and the rock mass will be different. The measurements from each rosette sensor and the known physical properties of each inclusion, the Young's modulus, the Poissons ratio, and the two principal stresses for the rock mass can be derived by known mathematical formula. Also, by overcoring at the end of the test period, the absolute secondary principal stresses can also be obtained.

4 Claims, 17 Drawing Figures

BOREHOLE GAUGE FOR IN-SITU MEASUREMENT OF STRESS AND OTHER PHYSICAL PROPERTIES

BACKGROUND OF THE INVENTION

1. Field of the Invention

The subject invention relates to the field of bore hole gauges that are used to measure in-situ the stress and physical properties of solid elastic masses.

2. Description of the Prior Art

In recent years, the primary means of measuring stress changes, absolute stress, or physical properties of a rock mass in-situ is to place some kind of instrument or gauge into a drill hole in the rock mass. The hole boundary then becomes one surface of a rock structure that surrounds the hole. If a gauge is placed in contact with this surface and the surface shape is changed, the gauge can respond to that change. This response is then used to estimate the rock stress or physical properties of the rock mass such as its' Young's modulus or Poisson's ratio.

There are generally two types of gauges. If the gauge changes its' size or shape and applies a pressure or force to the hole surface, the gauge may be called an "active" gauge. If the hole in the rock mass changes its size or shape and applies a pressure or force to the gauge, the gauge may be called a "passive" gauge.

Another way of classifying the "passive" gauges is as "deformation" or "stress" gauges. If the gauge is soft and does not interfere with the displacement of the hole boundary when the rock stress is changed, the gauge is a "displacement" gauge. The rock mass completely controls the resulting hole shape from which the rock stress is calculated from the physical properties of the rock mass obtained in the laboratory. If the drill hole is over-cored to obtain the laboratory sample, the absolute stress can also be calculated in the laboratory.

If the gauge is hard and completely controls the behavior of the hole surface when the rock mass is stressed, the gauge is a "stress" gauge. Since the rock mass contributes little to the resulting shape of the hole boundary, the physical properties of the rock mass are relatively unimportant. In practice, however, the stress gauge is not infinitely rigid and thus deforms, but this deformation is much less than would be the case for the open hole. However, the gauge still controls the behavior, and the physical properties of the rock mass are relatively less important than those of the gauge. This feature of the "stress" gauge is attactive and has resulted in the development of a variety of instruments of this type.

None of the gauges known at this time measure both the physical properties of the Young's modulus and Poisson's ratio, the change in rock stress, and the absolute stress in-situ without making use of laboratory measurements of rock properties.

In this invention, a method is presented which can measure these four quantities in-situ.

SUMMARY OF THE INVENTION

To practice the invention and to make the subject apparatus, first a hole is drilled in the rock mass. Then two separate inclusions of known but different physical properties are placed in the hole in such a manner as to be in intimate contact with the bore hole wall. Mid-length inside each inclusion is a sensor which will measure changes in strain or displacement in the bore hole.

The information supplied by the sensor can be used in the four independent equations set out below to calculate the principal stresses in a plane normal to the bore hole axis, as well as Poisson's ratio and Young's modulus all for the rock mass. Overcoring the bore hole will allow calculation of the absolute stress in the rock mass.

It is an object of this invention to disclose a means for measuring the state of stress and the physical properties of an elastic solid rock mass.

It is also an object of this invention to disclose an instrument which will provide the information from which the principal secondary stresses as well as Poisson's ratio and Young's modulus can be calculated.

It is further the object of the invention to disclose a means of measuring the strain within a rock mass.

It is yet a further object of the invention to disclose a means of measuring the displacement within a rock mass.

It is yet another object of the invention to disclose a method which will provide the information from which the absolute stress in the rock mass can be calculated.

DETAILED DESCRIPTION OF THE INVENTION

The present disclosure concerns a method and an apparatus that provides information from a single bore hole by which the calculation of the two principal stresses, the Poisson's ratio, and the Young's modulus can made. The invention is practiced by placing within the bore hole, in intimate contact with the bore hole boundary, two inclusions of known, but different physical properties, and including within each inclusion, at approximate mid-length, either a strain or displacement sensor. The sensors provides information from which the above-mentioned physical properties can be calculated when substituted into the equations set out below. At the end of the testing period, the bore hole can be overcored and information obtained from the sensors can then be used to calculate the absolute stress in the rock mass.

Figure 1:
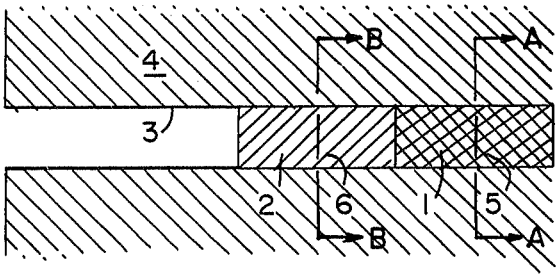
FIG. 1 shows a vertical longitudinal section through the centerline of a drill hole containing two cylindrical inclusions 1 and 2, with different, but known physical properties, each containing a strain or displacement, measuring means 5 and 6, cross-sections A—A and B—B showing the locations through the drill hole where strain or displacement means 5 and 6 are located.

FIG. 1 shows cylindrical inclusions 1 and 2 in a drill hole 3 in a rock mass 4. The lengths of the inclusions 1 and 2 are several times the diameter of the inclusions in order to satisfy the conditions for plane strain. The inclusions 1 and 2 should be placed in the bore hole under sufficient pressure to ensure that the inclusions radially press against the hole boundary and maintain intimate contact between the inclusions 1 and 2 and the bore hole boundary 3. This point is extremely important to the proper use of the invention, in that, if there is not intimate contact between the inclusions 1 and 2 and the bore hole boundary, there will be an incomplete interreaction between the rock mass 4 and the inclusions 1 and 2, resulting in inaccurate and misleading sensor readings.

Mid-length in inclusion 1, as shown in FIG. 1, is a strain or displacement sensor location 5. Mid-length in inclusion 2 is a strain or displacement location 6. At sensor location 5, an instrument to obtain the principal strains $\epsilon_{x1}$ and $\epsilon_{y1}$ for inclusion 1 in a plane normal to the bore hole is located. At sensor location 6, an instrument to obtain the principal strains $\epsilon_{x2}$ and $\epsilon_{y2}$ for inclusion 2 on a plane normal to the bore hole is located. The directions x and y are the principal strain directions. The physical properties of the inclusions 1 and 2 are different. Therefore, if there is a change in stress in the rock mass after the inclusions are placed, different strain or displacement measurements will be recorded at locations 5 and 6. From the known values of Young's modulus $E_1$, Poisson's ratio $\nu_1$, and the principal strains $\epsilon_{x1}$ and $\epsilon_{y1}$; for inclusions 1, and the corresponding known values of $E_2$, $\nu_2$, $\epsilon_{x2}$, and $\epsilon_{y2}$ for inclusion 2, the unknown values of the Young's modulus $E_r$, Poisson's ratio $\nu_r$ and $S_x$ and $S_Y$ the applied stress changes in the principal stress directions x and y for the rock mass can be calculated.

Figure 2:
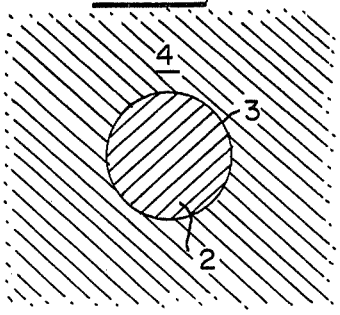
FIG. 2 shows an end view of the hole of FIG. 1.

FIG. 2 shows the end view of the hole boundary 3, the end of inclusion 2 and the rock mass 4 into which the hole is drilled.

Figure 3:
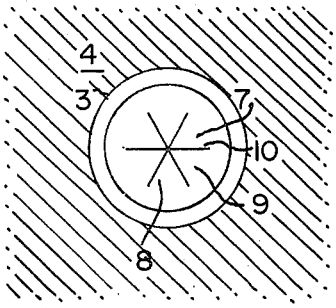
FIG. 3 shows a cross-section A—A of FIG. 1 with a strain rosette strain measuring means 7.
Figure 4:
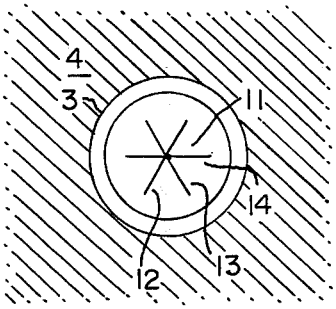
FIG. 4 shows a cross-section B—B of FIG. 1 with a strain rosette strain measuring means 11.

FIG. 3 shows the cross-section A—A of FIG. 1 at sensor location 5 where a strain rosette sensor 7 having arms 8, 9 and 10, is located while FIG. 4 shows the cross-section of B—B of FIG. 1 where a second strain rosette sensor 11 having arms 12, 13 and 14 is located.

Figure 5:
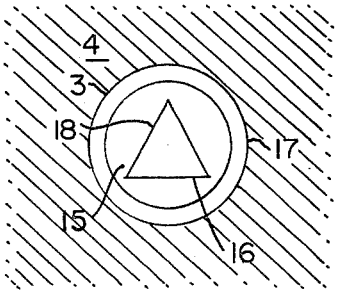
FIG. 5 shows a cross-section A—A of FIG. 1 with a displacement rosette displacement measuring means 15.
Figure 6:
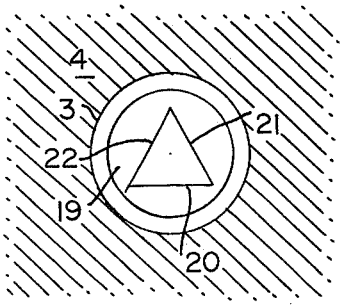
FIG. 6 shows a cross-section B—B of FIG. 1 with a displacement rosette displacement measuring means 19.

FIGS. 5 and 6 present the alternate configuration where in FIG. 5, cross-section A—A of FIG. 1 shows at sensor location 5 a displacement rosette 15 with arms 16, 17 and 18 is located in order to define the average strains for inclusion 1, and in FIG. 6, cross-sections B—B of FIG. 1 shows at sensor location 6 a displacement rosette 19 with arms 20, 21 and 22 is used to define the average strains for inclusion 2.

The strain rosettes 7 and 11 of FIG. 3 and FIG. 4 and the displacement rosettes 15 and 19 of FIG. 5 and FIG. 6 give the same results since the state of strain for the inclusions is uniform. That is, theoretically, the average strains calculated for the displacement rosettes should equal the strains from the strain rosettes.

When the stress in the rock mass 4 is changed after the inclusions 1 and 2 are in place, the boundary between the inclusions 1 and 2 and the hole boundary 3 will deform to produce strain or displacement in the sensor units 5 and 6. These are read experimentally by signals over the wires 23 and 24 of FIG. 7. The coupling of the inclusions 1 and 2 and the hole boundary 3 is very important if the expected results are to be obtained.

Figure 8:
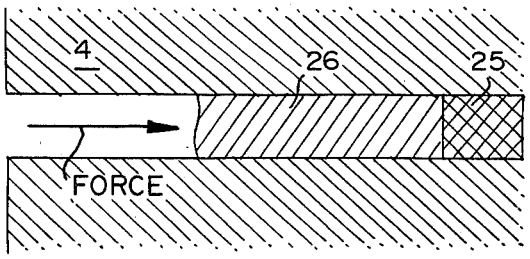
FIG. 8 shows the placement of the first half 25 of inclusion 1 as a solidifying resin or concrete under confining pressure by means of a placement tool 26.
Figure 9:
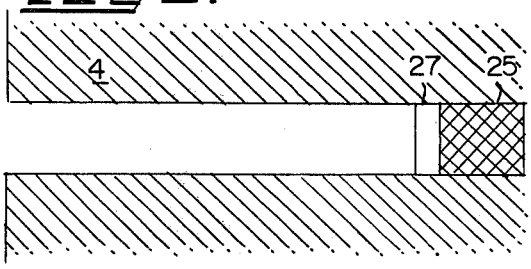
FIG. 9 shows the placement of the sensor unit 27 of inclusion 1.
Figure 10:
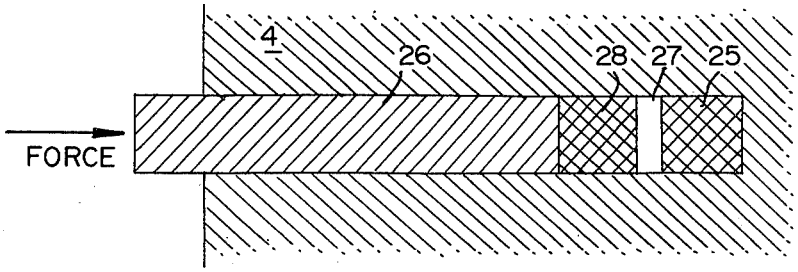
FIG. 10 shows the placement of the second half 28 of inclusion 1 as the same solidifying resin or concrete as the first half 25 of inclusion 1, under confining pressure.
Figure 11:
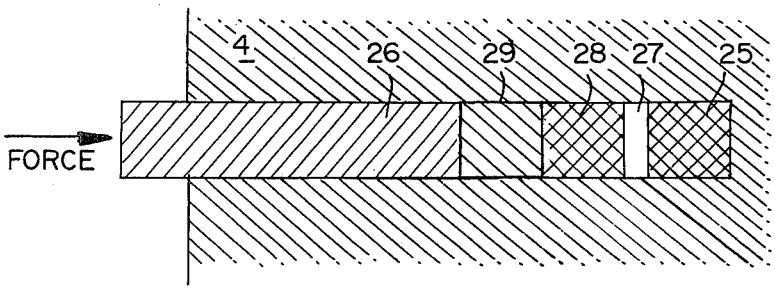
FIG. 11 shows the placement of the first half 29 of inclusion 2 as a second solidifying resin or concrete under confining pressure with solid properties different than those of inclusion 1.
Figure 12:
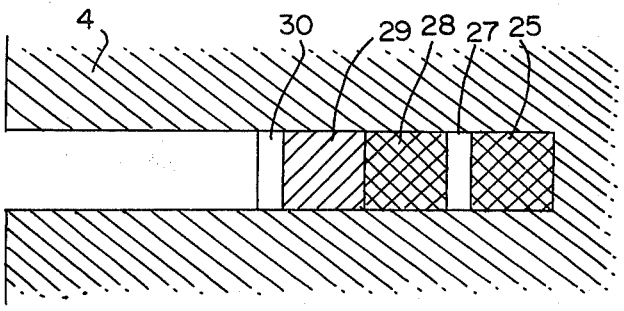
FIG. 12 shows the placement of the sensor unit 30 of inclusion 2.
Figure 13:
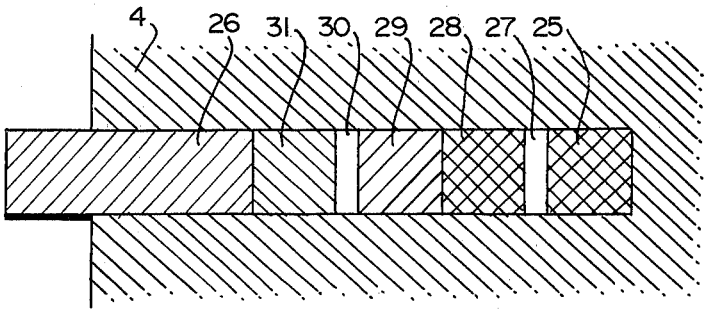
FIG. 13 shows the placement of the second half 31 of inclusion 2 as the same solidifying resin or concrete as the first half 29 of inclusion 2 of FIG. 12.

The following is the preferred method of inclusion placement. FIG. 8 shows a quantity of hardening liquid in the form of resin or concrete 25 which when placed in the end of the hole by means of a piston 26 that produces a hydrostatic state of stress during the hardening process. After the first half 25 of inclusion 1 is hard, the sensor unit 27 is placed, FIG. 9. This can be a solid disk of the same material as 25 with a strain rosette 7 or displacement rosette 11 attached to it or embedded in it. The second half 28 of inclusion 1 is placed as a liquid or concrete by a piston 26 that again provides a compressive stress during the hardening process as shown in FIG. 10. The first half 29 of inclusion 2 is placed and compressed by piston 26 until hard, as shown in FIG. 11. The material 29 is different than the material 25 and 28. After 29 is hard, the strain or displacement element 30 is placed, FIG. 12, the second half 31 of the inclusion 2 is placed as a liquid that hardens when confined by piston 26, FIG. 13. Elements 29 and 31 are of the same material.

Figure 7:
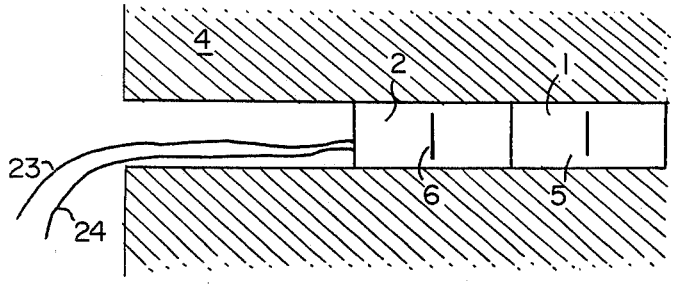
FIG. 7 shows a longitudinal section through the drill hole with wires 23 and 24 for transferring the strain or displacement measurements out of the drill hole.
Figure 14:
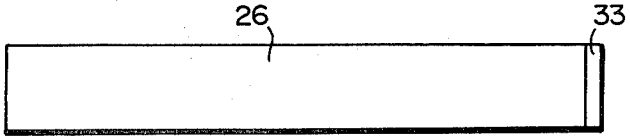
FIG. 14 shows a tool 26 for placing the inclusion parts 25, 27, 28, 29, 30, and 31 into the drill hole.
Figure 15:
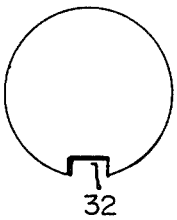
FIG. 15 shows the end view of the placing tool of FIG. 15.
Figure 16:
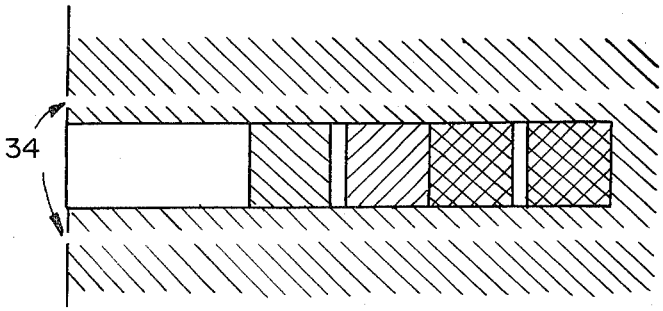
FIG. 16 shows the bore hole 3 after overcoring 34.

The wires 23 and 24 are lead out of the hole past the piston 26 as shown in FIG. 7 so that the strain or displacement changes for the sensors 7 and 11 or 15 and 19 can be read during the use of the instrument. FIG. 14 shows a side view of the piston 26. The piston 26 can conveniently have a groove cut into it 32 to provide clearance for the wires 23 and 24, as shown in FIG. 15. In addition, the piston has a sealing means 33 on the end that will confine the inclusion fluid under pressure until it becomes solid, as shown in FIG. 14.

The strains in a circular inclusion for the x and y principal strain directions are given by equations 23 for conditions of plane strain in the report "*A New Method of Analysis to Obtain Exact Solutions for Stress and Strains in Circular Inclusions,*" BuMines RI 7967, 1974, by the inventor.

$$\epsilon_x = (1/(2E'_i + E'_r))\{S_y[-3\,\nu'_i + (-1 + 3B)(1 - B\,\nu'_i)/(1 - B^2)] + S_x[3 - (-1 + 3B)(\nu'_i - B)/(1 - B^2)]\} \quad (1)$$

$$\epsilon_y = (1/(2E'_i + E'_r))\{S_y[3 - (-1 + 3B)(\nu'_i - B)/(1 - B^2)] + S_x[-3\,\nu'_i + (-1 + 3B)(1 - B\,\nu'_i)/(1 - B^2)]\}, \quad (2)$$

$$E'_i = E_i/(1 - \nu_i^2), \quad (3)$$

$$E'_r = E_r/(1 - \nu_r^2), \quad (4)$$

$$\nu'_i = \nu_i/(1 - \nu_i), \quad (5)$$

$$\nu'_r = \nu_r/(1 - \nu_r), \quad (6)$$

-continued $$\text{and } B = [E'_i(1 - \nu'_r) + \nu'_i E'_r]/(2E'_i + E'_r) \quad (7)$$

where $E_i$, $E_r$=Young's moduli of the inclusion and rock;

$\nu_i$, $\nu_r$=Poisson's ratio of inclusion and rock;

and $S_x$, $S_y$=applied stress changes in the rock in the principal stress directions, x and y.

In equations 1 and 2, $\epsilon_x$ and $\epsilon_y$ are expressed in terms of the variables $E_r'$, $\nu_r'$, $S_x$, Sy, $\nu_i'$, and $E_i'$. If $E_i'$ and $\nu_i'$ are known, the equations 1 and 2 become two equations in four unknowns. If two inclusions with different physical properties are used so that $E_1'$, $\nu_1'$, for inclusion 1 are not some linear combination of $E_2'$, $\nu_2'$ for inclusion 2, then four equations in four unknowns result. These can be solved for the four unknowns $E_r'$, $\nu_r'$, $S_x$, and $S_y$.

Four Equations in Four Unknowns—Principal Strains From Two Inclusions—Plane Strain Equations 1 through 7 for inclusion 1 become:

$$\epsilon_{x1} = (1/(2E'_1 + E'_r))\{S_y[-3\nu'_1 + (-1 + 3B_1)(1 - B_1\nu'_1)/(1 - B_1^2)] + S_x[3 - (-1 + 3B_1)(\nu'_1 - B_1)/(1 - B_1^2)]\} \quad (8)$$

$$\epsilon_{y1} = (1/(2E'_1 + E'_r))\{S_y[3 - (-1 + 3B_1)(\nu'_1 - B_1)/(1 - B_1^2)] + S_x[-3\nu'_1 + (-1 + 3B_1)(1 - B_1\nu'_1)/(1 - B_1^2)]\}, \quad (9)$$

$$\text{where } E'_1 = E_1/(1 - \nu_1^2), \quad (10)$$

$$E'_r = E_r/(1 - \nu_r^2), \quad (11)$$

$$\nu'_1 = \nu_1/(1 - \nu_1), \quad (12)$$

$$\nu'_r = \nu_r/(1 - \nu_r), \quad (13)$$

$$\text{and } B_1 = [E'_1(1 - \nu'_r) + \nu'_1 E'_r]/(2E'_1 + E'_r). \quad (14)$$

Equations 1 through 7 for inclusion 2 become:

$$\epsilon_{x2} = (1/(2E'_2 + E'_r))\{S_y[-3\nu'_2 + (-1 + 3B_2)(1 - B_2\nu'_2)/(1 - B_2^2)] + S_x[3 - (-1 + 3B_2)(\nu'_2 - B_2)/(1 - B_2^2)]\}, \quad (15)$$

$$\text{and } \epsilon_{y2} = (1/(2E'_2 + E'_r))\{S_y[3 - (-1 + 3B_2)/(1 - B_2^2)] + S_x[-3\nu'_2 + (-1 + 3B_2)(1 - B_2\nu'_2)/(1 - B_2^2)]\}, \quad (16)$$

$$\text{where } E'_2 = E_2/(1 - \nu_2^2), \quad (17)$$

$$E'_r = E_r/(1 - \nu_2^2), \quad (18)$$

$$\nu'_2 = \nu_2/(1 - \nu_2), \quad (19)$$

$$\nu'_r = \nu_r/(1 - \nu_r), \quad (20)$$

$$\text{and } B_2 = [E'_2(1 - \nu'_r) + \nu'_2 E'_r]/(2E'_2 + E'_r). \quad (21)$$

The four equations 8, 9, 15 and 16 for conditions of plane strain can be solved explicitly from $S_x$ and $S_y$ but not for $E_r$ and $\nu_r$. These equations can be solved based upon the considerations that follow. Equations 8 and 9 are solved for $S_x$ by eliminating $S_y$. Equations 15 and 16 are solved for $S_y$ by eliminating $S_x$. The measured inclusion principal strains and trial values of $E_r$ and $\nu_r$ are used to estimate $S_x$ and $S_y$. The $S_x$ and $S_y$ estimates and the trial values of $E_r$ and $\nu_r$ are then substituted into equations 8, 9, 15 and 16 to obtain estimates of the principal strains in the inclusions $\tilde{\epsilon}_{x1}$, $\tilde{\epsilon}_{y1}$, $\tilde{\epsilon}_{x2}$, and $\tilde{\epsilon}_{y2}$. The sum of variances, V, between the estimated principal strain values and the values measured experimentally, $\epsilon_{x1}$, $\epsilon_{y1}$, $\epsilon_{x2}$, and $\epsilon_{y2}$ is defined by the equation $$V = (\epsilon_{x1} - \tilde{\epsilon}_{x1})^2 + (\epsilon_{x2} - \tilde{\epsilon}_{x2})^2 + (\epsilon_{y1} - \tilde{\epsilon}_{y1})^2 + (\tilde{\epsilon}_{y2} - \epsilon_{y2})^2 \quad (22).$$

The search is continued with other trial values of $E_r$ and $\nu_r$ and the sum of the variances again calculated. The smallest sum of variances discovered is saved and compared to other trial results. The smallest variance found will correspond to the best fit between the experimental and estimated values of inclusion strains. That is, the best fit is defined by the minimum variance condition $$V_{min} = (\epsilon_{x1} - \bar{\epsilon}_{x1})^2 + (\epsilon_{x2} - \bar{\epsilon}_{x2})^2 + (\epsilon_{y1} - \bar{\epsilon}_{y1})^2 + (\epsilon_{y2} - \bar{\epsilon}_{y2})^2 \quad (23)$$

where $\bar{\epsilon}_{x1}$, $\bar{\epsilon}_{x2}$, $\bar{\epsilon}_{y1}$, and $\bar{\epsilon}_{y2}$ are the best fit trial values. The values of $S_x$ and $S_y$ corresponding to these best fit $E_r$, $\nu_r$ values are the best fit $S_x$, $S_y$ values. The directions of the principal strain or displacement in the inclusion are obtained by conventional means.

Figure 17:
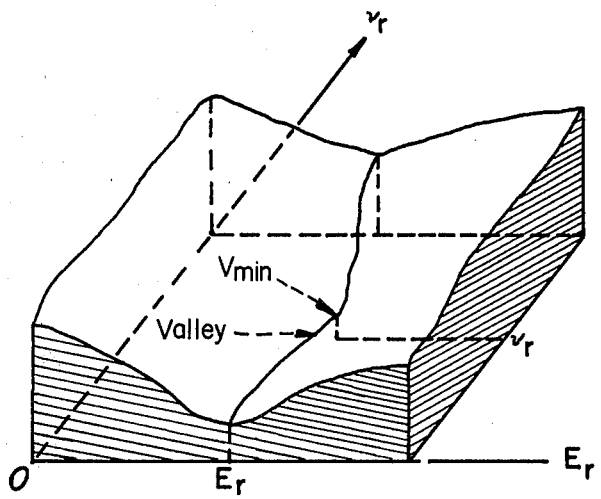
FIG. 17 shows a pictorial representation of a best fit of experimental data to the theory.

The variance V can be plotted against $E_r$ and $\nu_r$ as shown schematically in FIG. 17. The shape of this surface changes from one problem to the next. In general, however, the shape will have a valley and this valley has a point of minimum elevation, $V_{min}$. The $E_r$, $\nu_r$ coordinates at this location give the best values of $E_r$, $\nu_r$, $S_x$, and $S_y$. If the strains from the two inclusions are exact, the value of $V_{min}$ will be zero. If the strains are not exact but are consistent with respect to the physical conditions imposed by the problem, this value will also be near zero. If the strains are not consistent, as for example, if one inclusion indicates an increase in stress while the other indicates a decrease in stress, the value of $V_{min}$ will be large and will indicate that the solution is not acceptable and should not be used.

While the equations can be solved by hand, the more practical approach would be to solve the equations by use of a computer program. Description of one such program can be found in a soon to be published U.S. Bureau of Mines Report, *Theoretical Use of Two Drill Hole Inclusions To Measure the In Situ Stress and Physical Properties of a Rock Mass—A Method of Analysis*, by the inventor.

After the testing period is over, the entire bore hole can be overcored in order to release the stress in the rock mass 4 immediately adjacent to the bore hole and thus obtain strain or displacement readings that will allow calculation of the absolute stress in the rock mass for the entire time the gauge was in use.

What is claimed:

1. A method for obtaining in-situ data useful in deriving the unknown state of stress and the two unknown physical constants Young's modulus and Poisson's ratio for a solid elastic mass from a length of hole previously drilled into the mass comprising the steps of:

a. placing in said drill hole, a first inclusion with known physical properties and a measuring means which can provide data from which the principal strains in said first inclusion can be derived, and b. placing in said drill hole, a second inclusion with known but different physical properties than said first inclusion and a measuring means which can provide data from which the principal strains in said second inclusion can be derived, and c. processing the data derived from said first and second measuring means in each inclusion to arrive at the state of stress and the physical constants for the elastic solids.

2. A method according to claim 1 wherein said inclusions consists of a hardening fluid in the form of a resin or a concrete, each separate inclusion having known but different physical properties.

3. A method according to claim 1 wherein said measuring means for both the first and the second inclusion consists of a strain sensor placed in each inclusion and oriented to a plane normal to the axis of said drill hole.

4. A method of claim 1 wherein the absolute value of the stress in the solid elastic mass is determined by including the additional steps of:

d. overcoring said drill hole;

e. determining the change in strain or displacement due to the release of pressure in the solid elastic mass;

f. and thereafter processing the derived data to determine the absolute value of the stress in the rock mass.

* * * * *